US007109971B2

(12) United States Patent
Furukawa

(10) Patent No.: US 7,109,971 B2
(45) Date of Patent: Sep. 19, 2006

(54) JOYSTICK

(75) Inventor: Hitoshi Furukawa, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 489 days.

(21) Appl. No.: 10/712,098

(22) Filed: Nov. 14, 2003

(65) Prior Publication Data

US 2004/0095320 A1 May 20, 2004

(30) Foreign Application Priority Data

Nov. 14, 2002 (JP) ..... P2002-331109

(51) Int. Cl.
*G09G 5/08* (2006.01)

(52) U.S. Cl. ..... 345/161; 345/156; 463/38

(58) Field of Classification Search ..... 345/156, 345/161; 341/21, 34; 200/6 A, 6 R; 74/471 XY, 74/471 R; 273/148 B; 463/38, 37
See application file for complete search history.

(56) References Cited

U.S. PATENT DOCUMENTS 6,002,351 A * 12/1999 Takeda et al. ..... 341/20

6,670,945 B1 * 12/2003 Nakamura ..... 345/156

* cited by examiner

*Primary Examiner*—Bipin Shalwala
*Assistant Examiner*—Abbas Abdulselam
(74) *Attorney, Agent, or Firm*—Whitham, Curtis, Christofferson & Cook, PC

(57) ABSTRACT

A joystick includes an operating member, which has shaft portions respectively protruded from both side faces thereof, an upper rotary member, which supports the operating member so as to be pivotable in a first direction, a lower rotary member, which supports the operating member so as to be pivotable in a second direction perpendicular to the first direction and an urging member, which urges the lower rotary member and the upper rotary member so that the operating member is situated at a neutral position thereof. The lower rotary member has an elongated hole through which the operating member is passed, and the elongated hole extended in the first direction. The shaft portions are rotatably engaged in shaft holes which are formed in side walls of the elongated hole. Expansion parts are formed on the operating member so as to expand within the elongated hole in the first direction. The operating member rotates through the shaft portions so that both side faces of each expansion part slide along both inner wall faces of the elongated hole.

4 Claims, 5 Drawing Sheets

JOYSTICK

BACKGROUND OF THE INVENTION

The present invention relates to a small type joystick, and more particularly, to the small type joystick in which engaging performance of operating shafts projected from an operating member with respect to shaft holes which are formed in both side walls defining an elongated hole of a rotary member can be maintained, and at the same time, deformation of the rotary member will be prevented.

A related small type joystick will be described referring to FIGS. 4 to 7. In the drawings, reference numeral 1 designates a small type joystick (hereinafter, simply referred to as a joystick). The joystick 1 includes arms 3, 4 as rotary members perpendicular to each other which are provided above and below in a casing 2 so as to freely rotate. These arms 3, 4 are pivotally supported by the casing 2 at their respective opposite ends, and respective one end portions of the arms 3, 4 are coupled to variable resistors 5, 6 as outputting members.

Moreover, the arms 3, 4 are formed, in respective center parts thereof, with elongated holes 7, 8 which extend in a longitudinal direction of the arms 3, 4, and an operating stick 9 as an operating member is provided so as to pass through the elongated holes 7, 8. A lower end portion of the operating stick 9 is formed to have a convex spherical face 9*a*, while concave spherical portion 10*a* is formed in a center part of a base 10 of the joystick 1 so that the convex spherical face 9*a* may be rotatably mounted on the concave spherical portion 10*a*. Further, a knob (not shown) is fitted to an upper end of the operating stick 9.

Accordingly, when the operating stick 9 is operated, the operating stick 9 rotates on the concave spherical portion 10*a* making it as a rotation pivot, thereby to rotate the arms 3, 4. Then, the arms 3, 4 rotate the variable resistors 5, 6 which are coupled to the arms 3, 4, and the variable resistors 5, 6 produce outputs depending on the rotation of the operating stick 9.

In addition, as shown in FIG. 5, the joystick 1 has shaft portions 11 which are laterally projected from a lower end part of the operating stick 9. The shaft portions 11 are rotatably engaged, in a manner of pin joint, in shaft holes 13 which are formed in center parts of both side walls 12 defining the elongated hole 8 of the lower arm 4, and the operating stick 9 is fixed to the arms 3, 4 in a vertical direction. Moreover, in order to hold the arms 3, 4 in neutral positions, a coil spring 15 is interposed between the base 10 and a ring-like support member 14 which has a large opening in its center part which is abutted against a lower face of the lower arm 4 and has an inverted concave shape in cross section.

In the above related small type joystick, the shaft portions projected from the lower part of the operating stick are forced to be elastically inserted into the shaft holes which are formed in the lower rotary member, and rotatably engaged therein. Therefore, especially in such a mechanism that the operating shaft and the rotary member is engaged with each other, the rotary member need to be flexed, and so, rigidity of the rotary member cannot be increased. Under the circumstances, in case where a user has violently operated this small type joystick, the rotary member which is recovered to the neutral position by the coil spring is subjected to a violent force. Particularly, the rotary member will receive much more load at positions near the shaft portions of the operating stick, due to a load from the above and leverage. Then, this load will make the rotary member deformed and remarkably damage durability of the rotary member. This phenomenon will be prominent in case of the small type joystick formed of plastics by molding.

SUMMARY OF THE INVENTION

It is therefore an object of the present invention to provide a rigid and durable joystick in which engaging performance of the operating shafts provided on the operating member with respect to the shaft holes provided in the rotary member can be maintained, and the rotary member and so on will not be deformed even though a user operates violently the joystick.

In order to achieve the above object, according to the present invention, there is provided a joystick, comprising:

an operating member, which has shaft portions respectively protruded from both side faces thereof;

an upper rotary member, which supports the operating member so as to be pivotable in a first direction;

a lower rotary member, which supports the operating member so as to be pivotable in a second direction perpendicular to the first direction; and an urging member, which urges the lower rotary member and the upper rotary member so that the operating member is situated at a neutral position thereof, wherein the lower rotary member has an elongated hole through which the operating member is passed, and the elongated hole extended in the first direction;

wherein the shaft portions are rotatably engaged in shaft holes which are formed in side walls of the elongated hole;

wherein expansion parts are formed on the operating member so as to expand within the elongated hole in the first direction; and wherein the operating member rotates through the shaft portions so that both side faces of each expansion part slide along both inner wall faces of the elongated hole.

Preferably, the expansion parts are extended until a range corresponding to a length of the elongated hole in the first direction.

In the above configurations, not only assembling performance can be maintained in the same manner as in the related joystick, but also, even though the user has violently operated the joystick of the present invention, the recovering action of the urging member which is exerted when the rotary member is recovered to the neutral position by the urging member will be transmitted to the operating member by way of the whole bodies of the expansion parts which are in contact with substantially the entire length of the inner wall faces of the elongated hole. Thus, partial deformation of the rotary member as in the related joystick will be avoided, even though the rotary member is not provided with sufficient rigidity. Therefore, the rotary member will be restrained from deformation, and so, long life of the joystick can be anticipated.

Preferably, the expansion parts have flat portions at shaft portion sides respectively. The flat portions are continuous and flush with the side faces having the shaft portions of the operating member respectively. The flat portions and the side faces of the operating member form flat parts at the shaft portion sides respectively. The shaft portions are respectively provided on substantially center parts of the flat parts.

In the above configuration, when the operating member is rotated by way of the operating shafts, the operating member rotates and slides like a seesaw while the flat portions are in contact with the inner wall faces of the rotary member, and the flat portions are evenly abutted against the inner wall faces of the rotary member to disperse an action force of the urging member. Therefore, more smooth operation of the operating member can be obtained.

Preferably, outer end faces of the expansion parts are respectively formed in a curved shape.

In the above configuration, when the operating member rotates while sliding in the elongated hole of the rotary member, the operating stick will not interfere with the inner wall faces of the elongated hole, and therefore, operating performance of the operating member can be much more improved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Now, an embodiment of the invention will be described in detail, referring to FIGS. 1 to 3. It is to be noted that the same constituent elements as in the related joystick will be described at the same time, for convenience of explanation.

Figure 1:
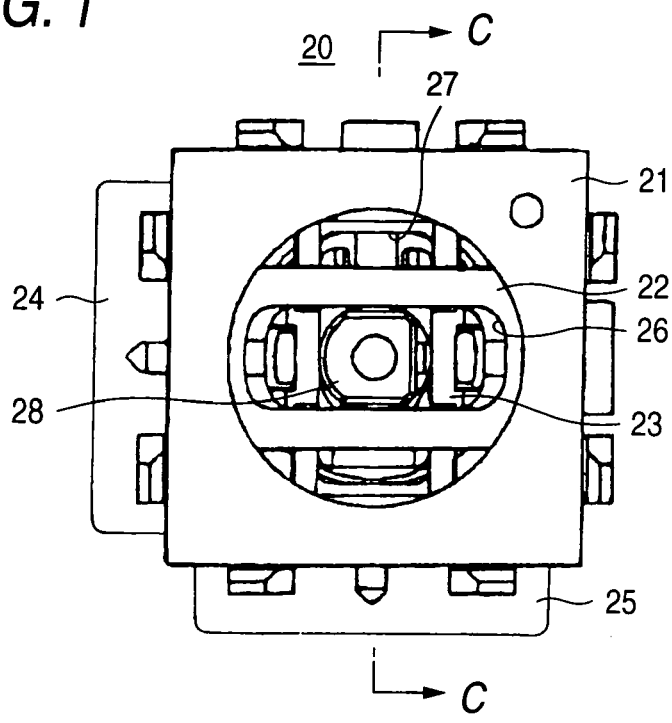
FIG. 1 is a plan view of a joystick according to an embodiment of the present invention.

In FIG. 1, a joystick 20 includes an upper arm 22 as an upper rotary member and a lower arm 23 as a lower rotary member which are perpendicular to each other and are provided above and below in a casing 21 so as to freely rotate. These upper arm 22 and lower arm 23 are pivotally supported by the casing 21 at their respective opposite ends, and respective one end portions of the upper arm 22 and the lower arm 23 are coupled to variable resistors 24, 25.

Moreover, the upper arm 22 and the lower arm 23 have respectively elongated holes 26, 27 in respective center parts thereof, and the elongated holes 26, 27 extends in longitudinal directions of the upper arm 22 and the lower arm 23 respectively. An operating stick 28 as an operating member is provided so as to pass through the elongated holes 26, 27. A convex spherical portion 28*a* is formed on a lower end portion of the operating stick 28. On the other hand, a concave spherical portion 21*a* is formed in a center area of an upper part of a base 21*b* of the joystick 20 so that the convex spherical portion 28*a* may be mounted on the concave spherical portion 21*a* so as to freely swing. Further, a knob (not shown) is fitted to an upper end of the operating stick 28.

Accordingly, in the above described joystick 20, when the operating stick 28 is operated, the operating stick 28 rotates on the concave spherical portion 21*a* making it as a rotation pivot, thereby the upper arm 22 and the lower arm 23 are rotated. Then, the upper arm 22 and the lower arm 23 will rotate the variable resistors 24, 25 coupled to the upper and lower arms 22, 23, and the variable resistors 24, 25 produce outputs based on the rotation of the operating stick 28.

In addition, in order to maintain the upper arm 22 and lower arm 23 respectively in neutral positions, a coil spring 30 is interposed between the base 21*b* and a ring-like support member 29 which is abutted against a lower face of the lower arm 23, in the same manner as in the related joystick. More specifically, the coil spring 30 elastically urges the lower arm 23 upwardly, thereby to maintain the upper arm 22 and the lower arm 23 in their neutral positions.

Figure 2:
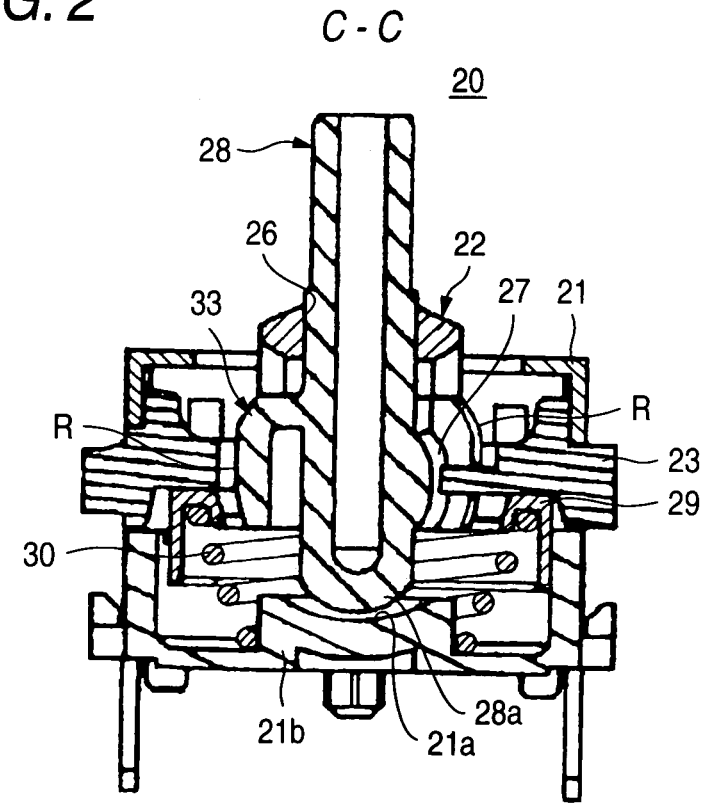
FIG. 2 is a sectional view taken along a line C—C in FIG. 1.
Figure 3:
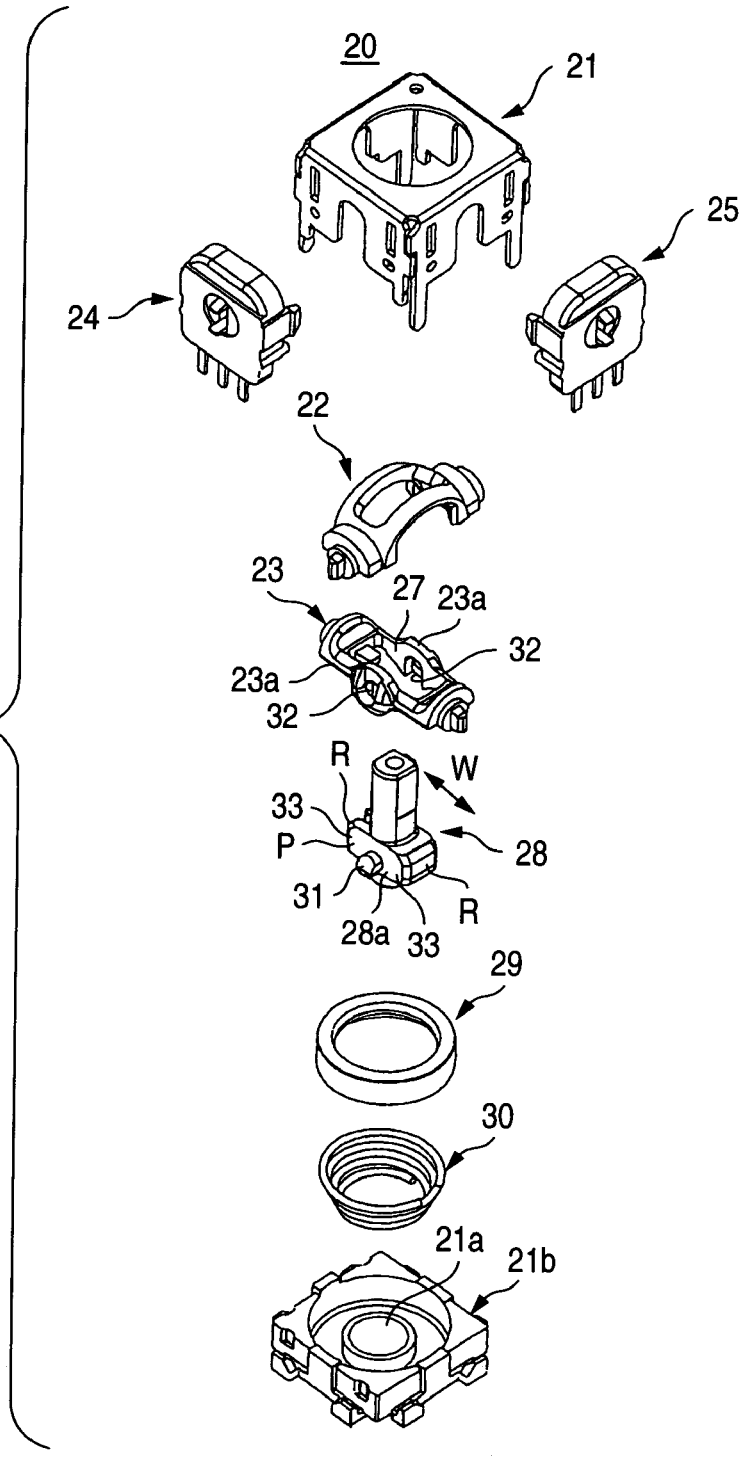
FIG. 3 is an exploded perspective view of the joystick.
Figure 4:
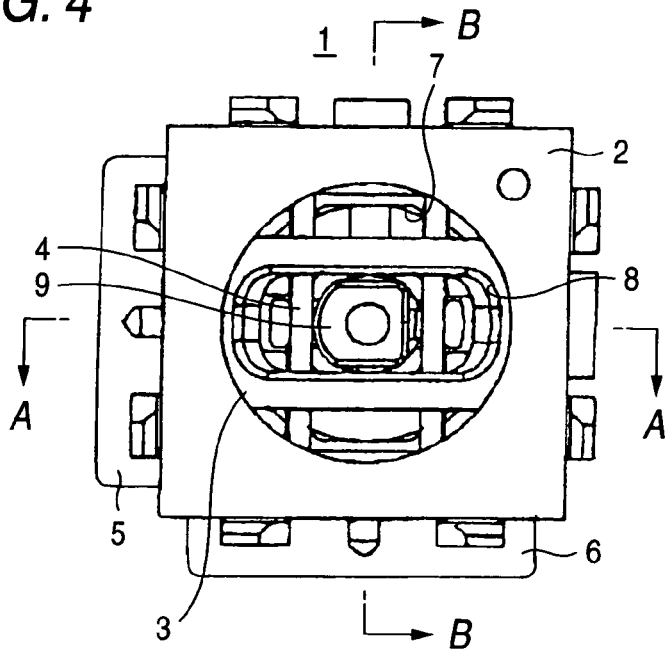
FIG. 4 is a plan view of a joystick in the related joystick.
Figure 5:
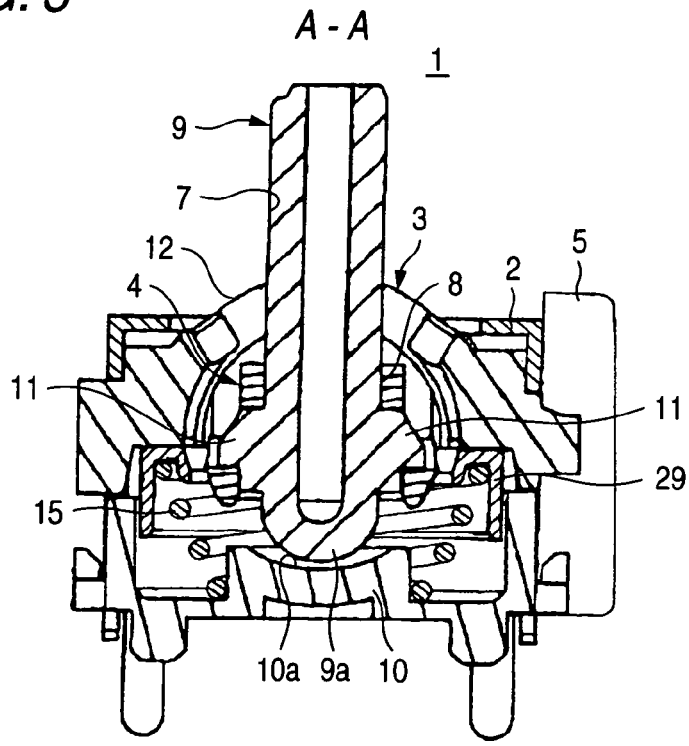
FIG. 5 is a sectional view taken along a line A—A in FIG. 4.
Figure 6:
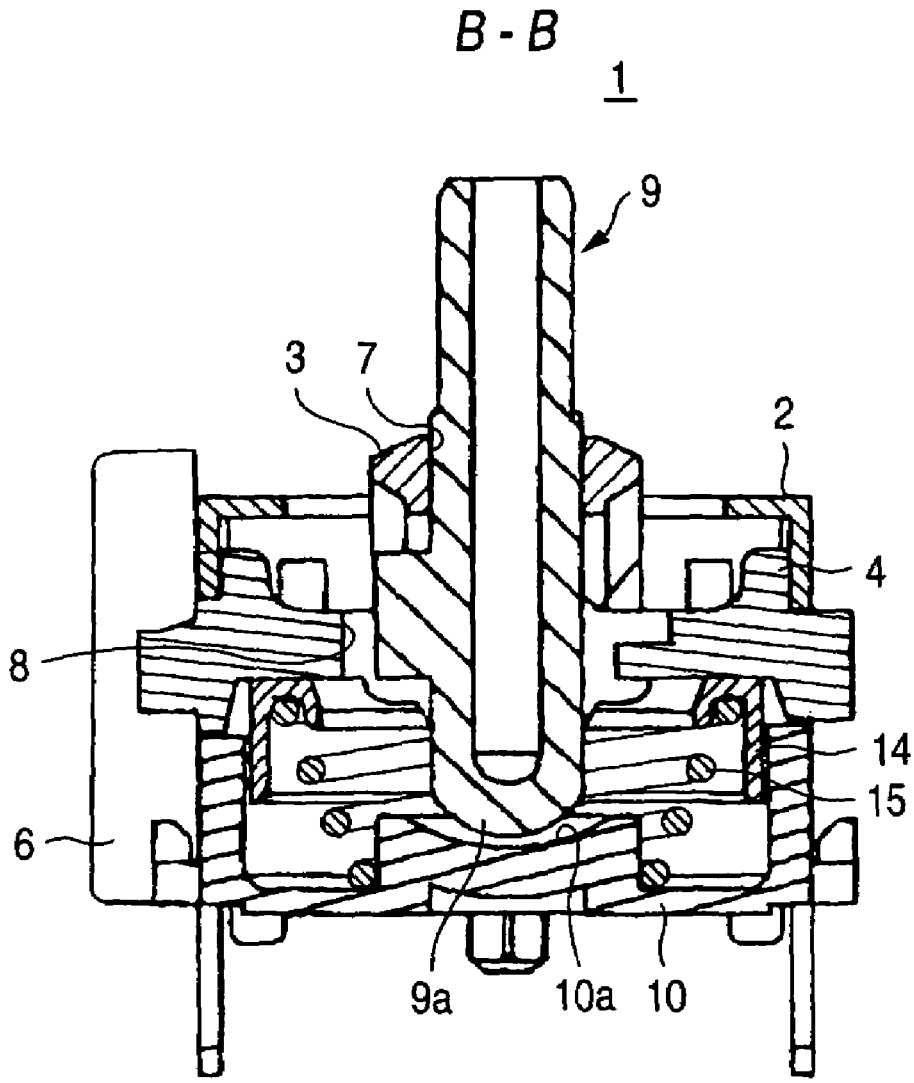
FIG. 6 is a sectional view taken along a line B—B in FIG. 4.
Figure 7:
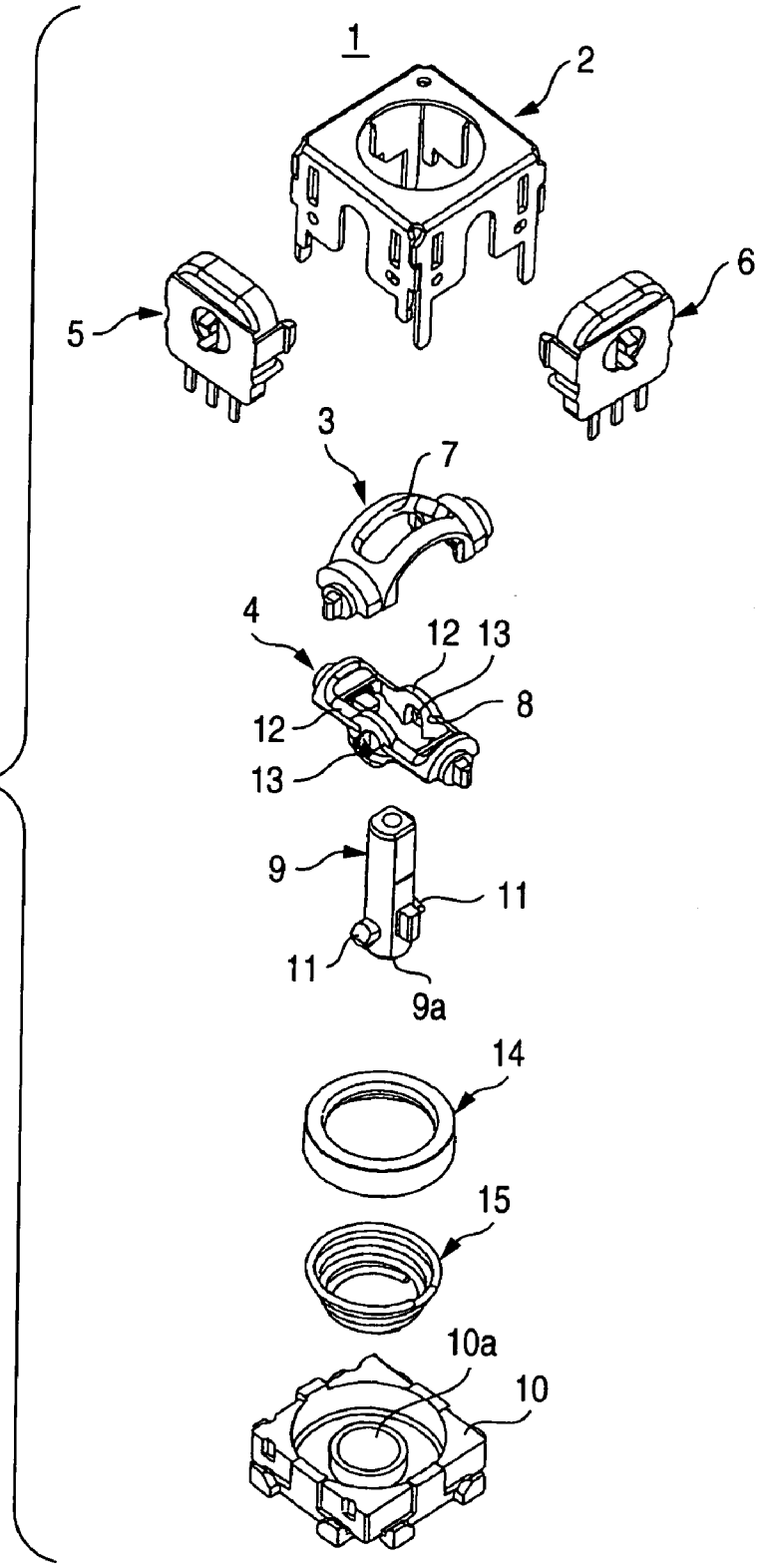
FIG. 7 is an exploded perspective view of the related joystick.

Further, the operating stick 28 is provided with operating shafts 31 in its lower part as shown in FIGS. 2 and 3, in the same manner as the related joystick.

On the other hand, as shown in FIG. 3, the lower arm 23 is provided with shaft holes 32 in respective center parts of right and left side walls 23*a* of the elongated hole 27. Accordingly, the shaft holes 32 are formed to have such a size as corresponding to a size of the operating shafts 31 provided on the operating stick 28, so that they can be idly engaged with each other. Still further, the right and left operating shafts 31 may have different sizes from each other, and the shaft holes 32 corresponding thereto may have also different sizes from each other. In this case, when the right and left operating shafts 31 are rotatably engaged in the shaft holes 32 individually, the operating shafts 31 of the operating stick 28 will be unable to be engaged in the shaft holes 32 even though they are fitted in wrong directions of the right and left. Therefore, the direction of mounting the operation stick 28 will not be mistaken.

Still further, the operating stick 28 is provided with expansion parts 33 which are projected to the right and left from a lower part of the operating stick 28 at both sides of the operating shafts 31. Both front and back faces of the expansion parts 33 at the sides of the operating shafts 31 are formed in flat planes P so that the expansion parts can slide along inner wall faces of the elongated hole 27 formed in the lower arm 23. The operating shafts 31 are provided at center parts of the flat planes P so as to project to the front and to the back respectively. Still further, a length in a lateral direction W of the flat planes P of the expansion parts 33, in short, the entire length of the expansion parts 33 in the lateral direction W is such an extent as corresponding to a longitudinal length of the elongated hole 27 formed in the lower arm 23. Therefore, the front and back flat planes P of the expansion parts 33 are abutted against the front and back inner wall faces of the elongated hole 27 along substantially the entire length of the inner wall faces.

In order to perform a smooth rotation of the operating stick 28, while the expansion parts 33 of the operating stick 28 which are provided along substantially the entire length of the elongated hole 27 are rotated to slide along the inner wall faces of the elongated hole 27 like a seesaw, laterally opposite outer end faces of the expansion parts 33 may be respectively formed in curved faces R. In this case, when the operating stick 28 is rotated like a seesaw, the outer end portions of the expansion parts 33 will not interfere with the right and left inner wall faces of the elongated hole 27, and the rotating operation of the operating stick 28 will not be hindered.

It is apparent that in order to prevent an assembling error, the joystick 20 may be provided with a restricting part for restricting an assembling direction to a determined direction, and for this purpose, various modifications may be added to shapes of the components, and that the joystick 20 is so constructed that these components are assembled to each other in the casing 21 so as to smoothly exert functions as the joystick.

Consequently, in case where the user has violently operated the joystick 20 according to the invention, even though a violent force is acted on the lower arm 23 which is recovered to the neutral position by the coil spring 30, the recovering force of the coil spring 30 is shared by the entire faces of the flat planes P of the expansion parts 33 which are provided on the operating stick 28, in a state abutted against the front and back inner wall faces of the elongated hole 27 of the lower arm 23. Accordingly, even though sufficient rigidity cannot be given to the rotary member as in the prior art, the recovering force will be evenly acted on the entire faces of the elongated hole 27, and so, deformation of the lower arm 23 will be prevented. Therefore, reliable durability of the small type joystick 20 can be expected.

It is to be noted that various modifications can be made in the present invention, unless deviating from the spirit of the invention, and it would be apparent that the invention also covers those modifications.

What is claimed is:

1. A joystick, comprising:

an operating member, which has shaft portions respectively protruded from both side faces thereof;

an upper rotary member, which supports the operating member so as to be pivotable in a first direction;

a lower rotary member, which supports the operating member so as to be pivotable in a second direction perpendicular to the first direction; and an urging member, which urges the lower rotary member and the upper rotary member so that the operating member is situated at a neutral position thereof, wherein the lower rotary member has an elongated hole through which the operating member is passed, and the elongated hole extended in the first direction;

wherein the shaft portions are rotatably engaged in shaft holes which are formed in side walls of the elongated hole;

wherein expansion parts are formed on the operating member so as to expand within the elongated hole in the first direction; and wherein the operating member rotates through the shaft portions so that both side faces of each expansion part slide along both inner wall faces of the elongated hole.

2. The joystick as set forth in claim 1, wherein the expansion parts are extended until a range corresponding to a length of the elongated hole in the first direction.

3. The joystick as set forth in claim 1, wherein the expansion parts have flat portions at shaft portion sides respectively;

wherein the flat portions are continuous and flush with the side faces having the shaft portions of the operating member respectively;

wherein the flat portions and the side faces of the operating member form flat parts at the shaft portion sides respectively; and wherein the shaft portions are respectively provided on substantially center parts of the flat parts.

4. The joystick as set forth in claim 1, wherein outer end faces of the expansion parts are respectively formed in a curved shape.

* * * * *